US009464834B2

(12) United States Patent
Murray

(10) Patent No.: US 9,464,834 B2
(45) Date of Patent: Oct. 11, 2016

(54) TEMPERATURE CONTROLLED SERVICE HOSES FOR IMPROVED REFRIGERANT CHARGE ACCURACY

(71) Applicant: Service Solutions U.S. LLC, Warren, MI (US)

(72) Inventor: Gary Murray, Montpelier, OH (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 778 days.

(21) Appl. No.: 13/803,752

(22) Filed: Mar. 14, 2013

(65) Prior Publication Data

US 2014/0260352 A1 Sep. 18, 2014

(51) Int. Cl.
*F25B 45/00* (2006.01)

(52) U.S. Cl.
CPC ..... *F25B 45/00* (2013.01); *F25B 2345/001* (2013.01); *F25B 2345/007* (2013.01)

(58) Field of Classification Search
CPC ..... F25B 2345/00; F25B 2345/001; F25B 2345/005; F25B 2345/003; F25B 2700/04; F25B 45/00
See application file for complete search history.

(56) References Cited

U.S. PATENT DOCUMENTS 6,469,300 B1 * 10/2002 Trigiani ..... G60H 1/00585 250/302

* cited by examiner

*Primary Examiner* — Cassey D Bauer
(74) *Attorney, Agent, or Firm* — Baker Hostetler LLP

(57) ABSTRACT

A method and charging apparatus for adding refrigerant to refrigerant system are provided. The disclosure includes thermally conditioning the interior of the service hoses of a refrigerant recovery unit used to charge refrigerant. The conditioning may be based on one or more temperature reading(s) and/or based on a function and may be achieved by a heater along the length of the hose, recirculating refrigerant, and/or through a parallel line of heated liquid.

21 Claims, 6 Drawing Sheets

TEMPERATURE CONTROLLED SERVICE HOSES FOR IMPROVED REFRIGERANT CHARGE ACCURACY

FIELD OF THE INVENTION

The present invention relates generally to a system and method for charging and/or recharging refrigerant systems. In particular, the present invention related to improving charge accuracy of refrigerant recovery units by controlling the temperature of one or more refrigerant service hose(s).

BACKGROUND OF THE INVENTION

Refrigeration systems are currently commonplace in commercial and residential buildings, and a variety of vehicles including, for example, automobiles, aircrafts, watercrafts, and trains. Over time, the refrigerant included in refrigeration systems its depleted and/or contaminated. As such, in order to maintain the overall efficiency and efficacy of a refrigeration system, the refrigerant included therein may be periodically replaced or recharged.

Refrigerant recovery units or carts are used in connection with the service and maintenance of refrigeration systems, such as air conditioning (A/C) systems. The refrigerant recovery unit connects to the A/C system to recover refrigerant out of the system and separate out oil and contaminants from the refrigerant in order to recharge or replace refrigerant into the A/C system.

The ability to obtain accurate weight measurements to get an accurate assessment of how much refrigerant is transferred to the A/C system is important to provide proper servicing. Inaccurate weight measurements result in inaccurate assessments of how much refrigerant actually was transferred to the A/C system during the charge, which can result in undercharging or overcharging the A/C system causing it to underperform. Consequently, in the automotive field, for example, the Society of Automotive Engineering (SAE) requires that refrigerant charging equipment have a charging accuracy of at least +/−15 grams in order to meet certification standards.

Refrigerant charging often needs to be conducted over a wide range of ambient and system conditions. Fluctuating conditions make the measuring and compensating for refrigerant charging changes difficult with existing charging equipment. For example, exposure of portions of the service hoses to a wide range of temperature ranges can cause undercharging as refrigerant tends to condense and remain in the cooler sections of refrigerant flow paths. Previously and currently used methods to equalize and clear flow paths are not optimal and sometimes forbidden by manufacturers' specified charging requirements.

As a consequence of the foregoing, a need exists for a refrigerant recovery unit and methods associated therewith that can improve the charge accuracy of refrigerant charging equipment such as refrigerant recovery units.

SUMMARY OF THE INVENTION

The foregoing needs are met, to a great extent, by the present disclosure, wherein in some aspects a refrigerant recovery unit configured to charge refrigerant with increased accuracy is provided. The refrigerant recovery unit can include a refrigerant storage tank configured to store a refrigerant, one or more service hoses configured to facilitate transfer of the refrigerant from the refrigerant storage tank to a refrigerant system, a first temperature sensor configured to determine a first temperature within the one or more service hoses, a second temperature sensor configured to determine a second temperature within the refrigerant recovery unit, and a controller configured calculate a first temperature differential between the first and second temperatures, and using the temperature differential to control a heater used to thermally control the temperature within the one or more service hoses.

In additional aspects of the disclosure, a refrigerant recovery unit can include a heater capable of heating the interior of said one or more service hoses before the transfer of refrigerant to a refrigerant system. The heater may be in communication and controlled by a controller which can also be in communication with one or more temperature sensors, the controller controlling the heater based on one or both temperature readings received and a preprogrammed function.

In yet additional aspects of the disclosure, a method of adding refrigerant to a refrigerant system is disclosed. The method which can include obtaining a recommended amount of refrigerant for the refrigerant system, obtaining a first temperature reading, conditioning the interior temperature of one or both service hose(s) according to said first reference temperature, and charging the refrigerant system with a recommended amount of refrigerant.

There has thus been outlined, rather broadly, certain embodiments of the disclosure in order that the detailed description thereof herein may be better understood, and in order that the present contribution to the art may be better appreciated. There are, of course, additional embodiments of the disclosure that will be described below and which will form the subject matter of the claims appended hereto.

In this respect, before explaining at least one embodiment of the disclosure in detail, it is to be understood that the disclosure is not limited in its application to the details of construction and to the arrangements of the components set forth in the following description or illustrated in the drawings. The disclosure is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

DETAILED DESCRIPTION

Figure 1:
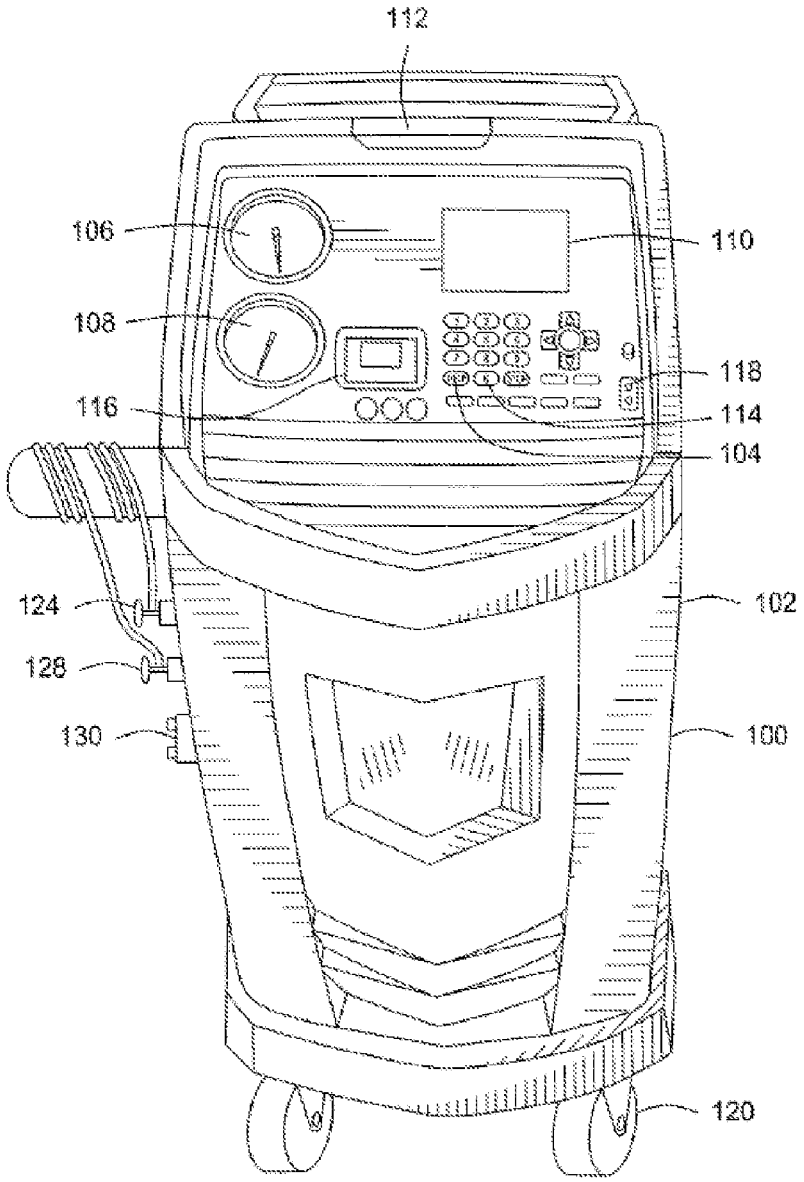
FIG. 1 is a front view illustration of an exemplary refrigerant recovery unit according to aspects of the disclosure.

According to aspects of the present disclosure, a refrigerant recovery unit that can include temperature controlled refrigerant service hoses leading to the refrigeration systems, including for example, A/C systems found in residential and commercial buildings, and a variety of vehicles including, automobiles, aircrafts, watercrafts, and trains, is provided. The refrigerant recovery unit can recover, recharge and/or replace an amount of depleted and/or contaminated refrigerant with increased accuracy thereby maintaining the overall efficiency and efficacy of the refrigerant system.

The disclosure will now be described with reference to the drawing figures. Throughout the description, the disclosure will now be described with reference to the drawings figures in which like reference numerals can refer to like parts throughout.

Beginning with FIG. 1, a front view of an exemplary refrigerant recovery unit 100 in accordance with some aspects of the disclosure is depicted. The refrigerant recovery unit 100 can include, for example, unit model number AC1234™ from Robinair™ based in Owatonna, Minn. (Service Solutions U.S. LLC). The refrigerant recovery unit 100 includes a housing 102 to house components of the unit. The housing 102 may be made of any material such as thermoplastic, steel and the like.

The housing 102 includes a control panel 104 that allows the user to operate the refrigerant recovery unit 100. The control panel 104 may be part of the housing 102 as shown in FIG. 1 or separated. The control panel 104 includes high and low gauges 106, 108, respectively. The gauges may be analog or digital as desired by the user. The control panel 104 has a display 110 to provide information to the user, such as certain operating status of the refrigerant recovery unit 100 or provide messages or menus to the user. Located near the display 110 can be LEDs 112 to indicate to the user the operational status of the refrigerant recovery unit 100. The LEDs 112 may indicate that the refrigerant recovery unit 100 is in the recovery, recycling or recharging mode, or indicate that the filter (not shown) needs to be changed, that there is a malfunction, or other indications.

A user interface 114 is also included on the control panel 104. The user interface 114 allows the user to interact and operate the refrigerant recovery unit 100 and can include an alphanumeric keypad and directional arrows. A power switch 118 or emergency shut off control can be included as part of the user interface 114. A printer 116 is provided to print out information, such as test results.

Figure 2:
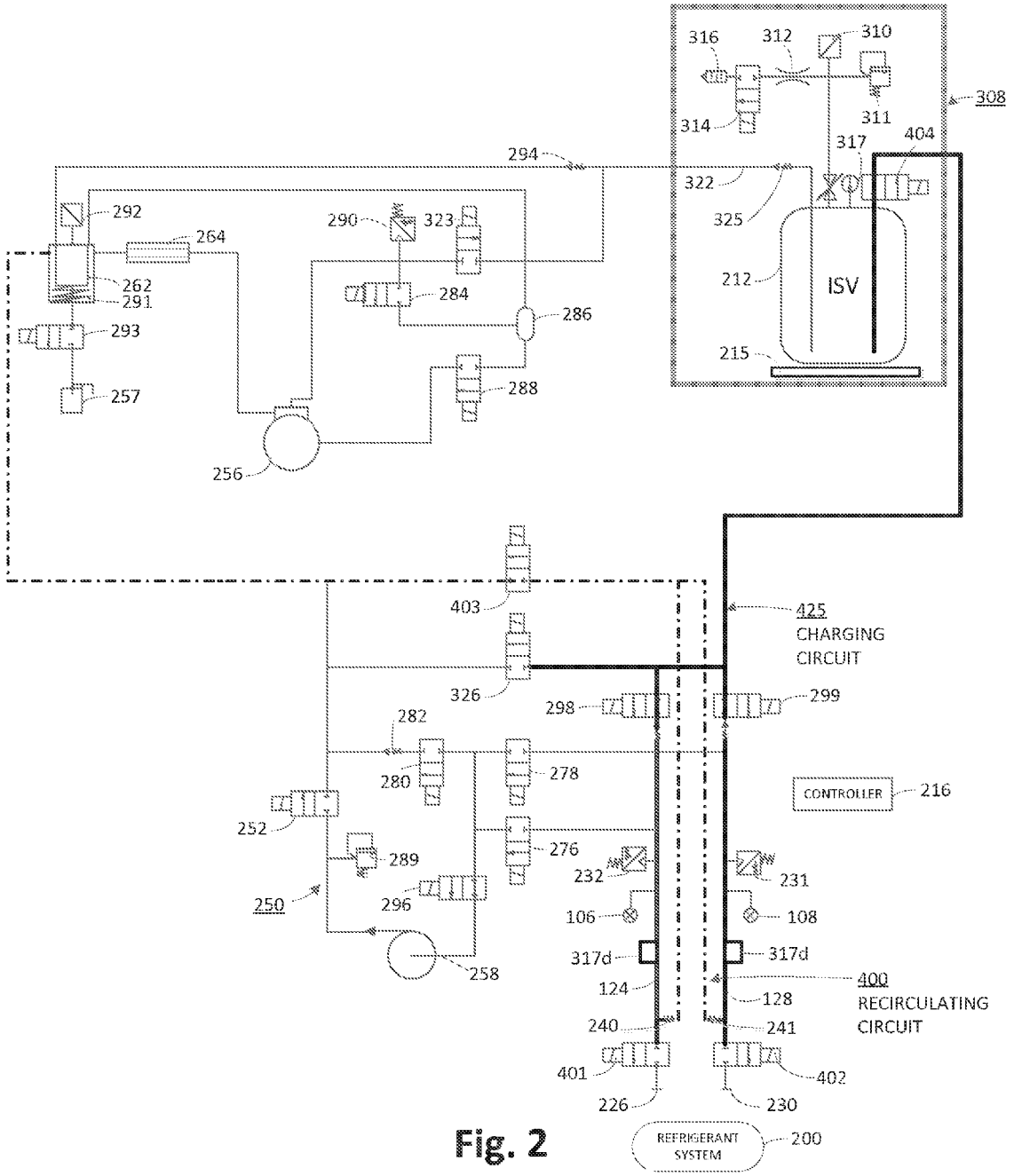
FIG. 2 is a flow diagram illustrating exemplary components of the refrigerant recovery unit of FIG. 1 according to aspects of the disclosure.
Figure 3:
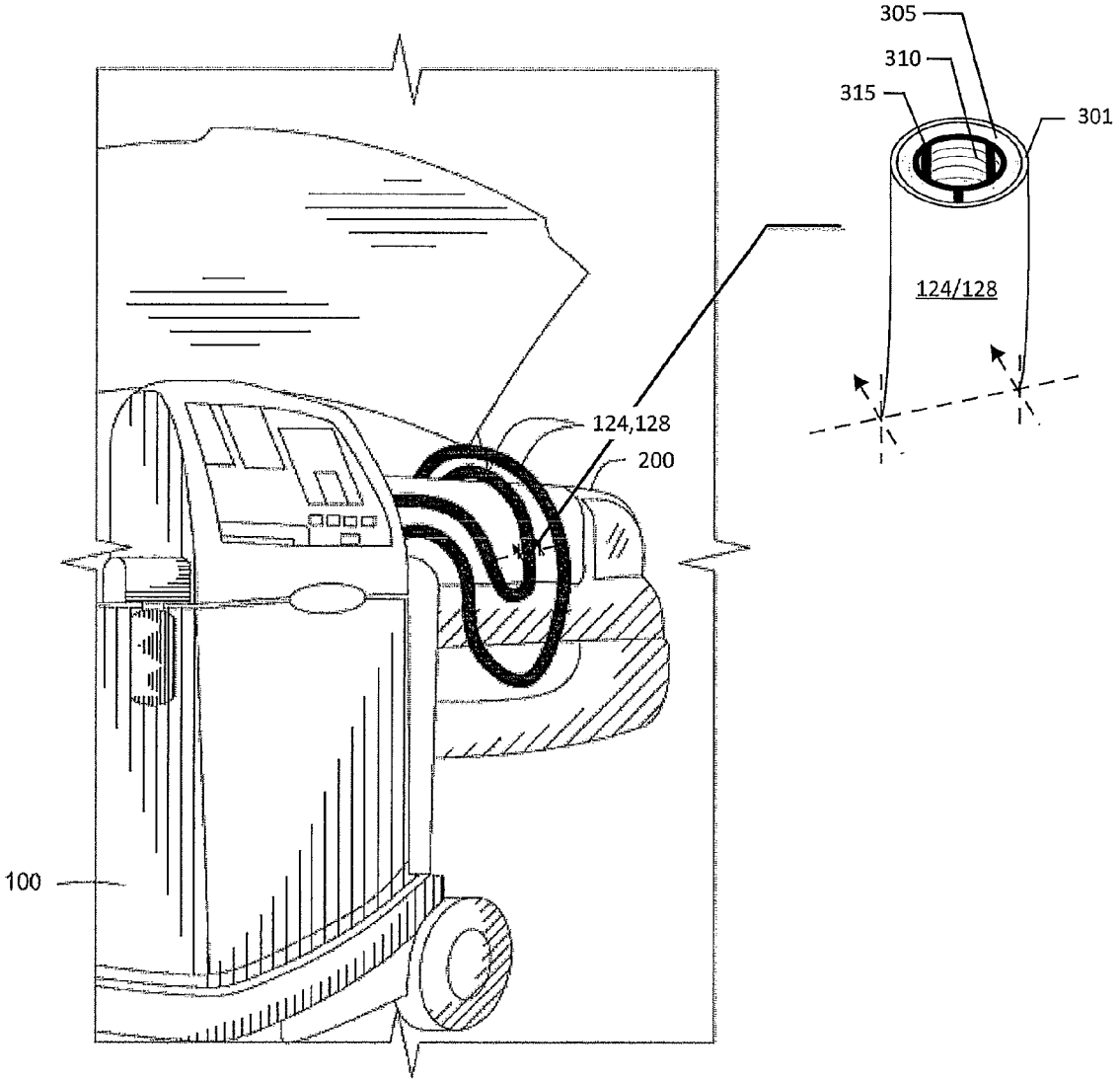
FIG. 3 is an illustration of a refrigerant recovery unit connected to a refrigerant system of a vehicle and an enlarged cross section of a service hose according to aspects of the disclosure.

The housing 102 further includes connections for service hoses 124, 128 that connect the refrigerant recovery unit 100 to a refrigerant containing device, such as a refrigerant system 200 (shown in FIG. 3). Also shown in FIG. 1, a connector interface 130 is provided so that a communication cable can be connected from the connector interface 130 to a data link connector included in some A/C systems including, for example, in vehicles having an A/C system. This can allow the refrigerant recovery unit 100 to communicate with a refrigerant system's controller 216 (shown in FIG. 2) and diagnose any issues with it. In order for the refrigerant recovery unit 100 to be mobile, wheels 120 are provided at a bottom portion of the system.

Referring now to FIG. 2 components included within and/or that may be included in refrigerant recovery units are depicted in a flow diagram according to aspects of the disclosure. In the following section, general functionality of the refrigerant recovery unit 100 and components therein are described.

In some embodiments, to service the refrigerant system 200, the service hoses 124, 128 can be coupled to the refrigerant system 200, via couplers 226 (high side) and 230 (low side), respectively. The couplers 226, 230 can be designed to be closed until they are coupled to the refrigerant system 200.

Recovery Cycle

The recovery cycle can be initiated by the opening of high pressure and low-pressure solenoids 276, 278, respectively. This allows the refrigerant within the refrigerant system 200 to flow through a recovery valve 280 and a check valve 282. The refrigerant flows from the check valve 282 into a system oil separator 262, where it travels through a filter/dryer 264, to an input of a compressor 256. Refrigerant is drawn through the compressor 256 through a normal discharge solenoid 284 and through a compressor oil separator 286, which circulates oil back to the compressor 256 through an oil return valve 288. The refrigerant recovery unit 100 may include a high-pressure switch 290 in communication with a controller 216, which can be programmed to determine an upper pressure limit, for example, about 435 psi, to optionally shut down the compressor 256 to protect the compressor 256 from excessive pressure.

The controller 216 can also be, for example, a microprocessor, a field programmable gate array (FPGA) or application-specific integrated circuit (ASIC). The controller 216 via a wired or wireless connection (not shown) controls the various valves and other components (e.g. vacuum pump 258, compressor 256) of the refrigerant recovery unit 100. In some embodiments of the present disclosure, any or all of the electronic solenoid or electrically activated valves may be connected and controlled by the controller 216.

A high-side clear solenoid 323 may optionally be coupled to the output of the compressor 256 to release the recovered refrigerant transferred from the compressor 256 to a path conduit leading into a refrigerant storage tank 212, instead of through a path conduit through the normal discharge solenoid 284.

A deep recovery valve 252 is provided to assist in the deep recovery of refrigerant. When the refrigerant from the refrigerant system 200 has, for the most part, entered into the refrigerant recovery unit 100, the remaining refrigerant may be extracted from the refrigerant system 200 through a deep recovery circuit 250 by opening the deep recovery valve 252 and turning on the vacuum pump 258. Additionally, a pressure relief 289 can be included to shut off the vacuum pump 258 when pressure in the deep recovery circuit 250 increases above a pre-determined level.

The heated compressed refrigerant can exit the system oil separator 262 and travel through a loop of conduit or heat exchanger 291 for cooling or condensing. As the heated refrigerant flows through the heat exchanger 291, the heated refrigerant gives off heat to the cold refrigerant in the system oil separator 262, and assists in maintaining the temperature in the system oil separator 262 within a working range. Coupled to the system oil separator 262 can be a switch or transducer 292, such as a low pressure switch or pressure transducer 310, for example, that senses pressure information, and provides an output signal to the controller 216 through a suitable interface circuit programmed to detect when the pressure of the recovered refrigerant is down to 13 inches of mercury, for example. An oil separator drain valve 293 can drain the recovered oil into a container 257. Finally, the recovered refrigerant can flow through a normal discharge check valve 294 along a refrigerant circuit 322 and, in some embodiments, through a vapor check valve 325 into the refrigerant storage tank 212.

Evacuation Cycle

The evacuation cycle can begin by the opening of the high pressure and low-pressure solenoids 276, 278 and a valve 296, leading to the input of a vacuum pump 258. Prior to opening the valve 296, an air intake valve (not shown) is opened, allowing the vacuum pump 258 to start exhausting air. The refrigerant of the refrigerant system 200 can then be evacuated by the closing of the air intake valve (not shown) and opening the valve 296, allowing the vacuum pump 258 to exhaust any trace gases remaining until the pressure is approximately 29 inches of mercury, for example. When this occurs, as detected by pressure transducers 231, 232, optionally, coupled to the high side 226 and low side 230 of the refrigerant system 200 and to the controller 216, the controller 216 may turn off the valve 296 allowing for the charging cycle to take place.

In embodiments where at least a portion of the recovery path conduit is shared with the flow path conduit leading to the oil separator for the charging process, as depicted, hose fill valves 401, 402 can remain open during the evacuation process. In other embodiments where there are separate paths for the evacuation and charging, the hose fill valves 401, 402 will preferably remain closed during the evacuation cycle to prevent oil contamination from the evacuated refrigerant.

Air Purging

An air purging apparatus 308 is also illustrated. The air purging apparatus 308 allows the refrigerant recovery unit 100 to be purged of non-condensable, such as air. Air purged from the refrigerant recovery unit 100 may exit the refrigerant storage tank 212, through an orifice 312, through a purging valve 314 and through an air diffuser 316. In some embodiments, the orifice 312 may be about 0.028 of an inch. A pressure transducer 310 can be used to measure the pressure contained within the refrigerant storage tank 212 and the air purging apparatus 308 accordingly. For example, the pressure transducer 310 may send the pressure information to the controller 216, and when the pressure is too high, as calculated by the controller 216, purging is required. In addition or alternatively, a high pressure relief 311 may be included to shut off the system when pressure increases above a pre-determined level.

The purging valve 314 may be selectively actuated to permit or not permit the air purging apparatus 308 to be open to the ambient conditions. A temperature sensor 317 may be coupled to the refrigerant storage tank 212 to measure the refrigerant temperature therein. The placement of the temperature sensor 317 may be anywhere on the refrigerant storage tank 212 or alternatively, the temperature sensor 317 may be placed within the refrigerant circuit 322. The measured temperature and pressure may be used to calculate the ideal vapor pressure for the type of refrigerant used in the refrigerant recovery unit 100. The ideal vapor pressure can be used to determine when the non-condensable gases need to be purged and how much purging will be done in order for the refrigerant recovery unit 100 to function properly.

Charging Cycle

Figure 6:
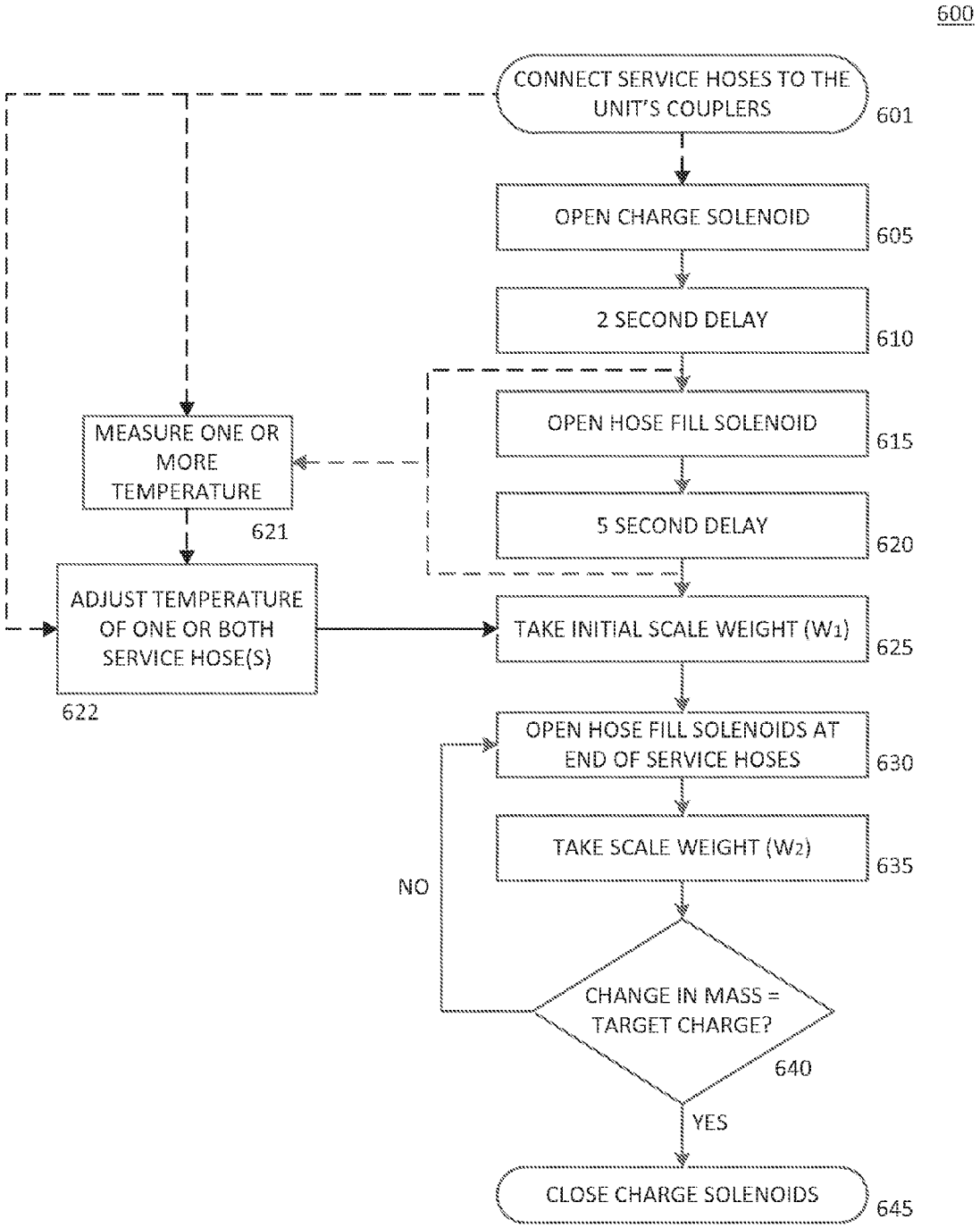
FIG. 6 is a flowchart illustrating method steps to charge a refrigerant system according to additional embodiments of the disclosure.

For purposes of clarity and in accordance to aspects of the disclosure, the charging cycle is explained in reference to method steps 600 of FIG. 6 along with the flow diagram illustrated in FIG. 2. FIG. 6 is a flowchart illustrating method steps 600 to charge a refrigerant system 200 according to aspects of the disclosure. In particular, the method steps 600 can be used to charge the refrigerant system 200 with increased accuracy by thermally conditioning the interior of one or both service hose(s) 124, 128 to a constant temperature before refrigerant is transferred. The temperature conditioning can be achieved using methods including, for example, by recirculating refrigerant and/or using a resistance heater 315 (shown in FIG. 3) along the length of the service hoses 124, 128.

Recirculating of heated refrigerant may take place in more than one way depending on the refrigerant recovery unit 100. For example, by heating refrigerant through normal ISV conditioning and recirculating the refrigerant through the service hoses 124, 128 for conditioning, either by, connecting the couplers 226, 230 to refrigerant recovery unit 100 storage ports (not shown) and initiating a power charge sequence recirculating heated refrigerant prior to charging the refrigerant system 200, or by including recirculating circuit 400 connected to or near the system interface coupler ends 226, 230 of the service hoses 124, 128 and recirculating heated refrigerant as further described hereon.

Starting at step 601, the service hoses 124, 128 can be coupled to the refrigerant system 200, via the couplers 226 (high side) and 230 (low side), respectively. In some embodiments, as depicted in the flow diagram of FIG. 2, at step 605 of FIG. 6, the charging cycle can begin, for example subsequent to the evacuation cycle, by opening valve 404 to allow the refrigerant in the refrigerant storage tank 212, which is at a pressure of approximately 70 psi or above, to flow through open high side charge valve 298 and fill the service hose up to the hose fill valve(s) 401. In addition, at step 605, optionally low side charge valve 299 can also be opened to fill the low side service hose up to hose fill valve(s) 402. In another embodiment, in order to charge the refrigerant system 200, the power charge valve 326 may be opened and a tank fill structure (not shown) may be used. Alternatively or in addition to, the tank fill structure (not shown) may also be used to fill the refrigerant storage tank 212. In yet another embodiment, valve 404 can be eliminated using check valves 240 and 241 to prevent refrigerant flow from the recirculating circuit 400 into the service hoses 124, 128, and thereby allowing the filling of service hoses 124, 128 with heated refrigerant to be initiated by the opening the high side charge valve 298 and low side charge valve 299.

At step 610, at time delay function can take place to allow one or both of the service hoses 124, 128 to fill up with refrigerant. The time delay function may be, for example, about a 2 second time delay function to allow refrigerant to flow into the service hoses 124, 128 and a portion of the recirculating circuit 400 leading up to a recirculating valve 403. Other time delays can include 1, 3, 4, 5, . . . etc., seconds delays as predetermined, or in some embodiments, adjusted based on measured sensor data. At step 615, subsequent to filling one or both of the service hoses 124, 128 and the portion of the recirculating circuit 400 leading up to a recirculating valve 403 with refrigerant, the recirculating valve 403 is opened to recirculate refrigerant from the coupler ends of the high end service hose 124 and the low end service hose 128 to the system oil separator 262, which in some embodiments can preferably be in a vacuum, to allow removing of vapor refrigerant contained in the service hoses 124, 128 and thermally condition the service hoses 124, 128 to an acceptable charging temperature throughout their length.

In some embodiments, at step 620, a second time delay function can keep the recirculating valve 403 open during the time delay thereby allowing refrigerant to recirculate from the distal end of the service hoses 124, 126 in relation to the refrigerant recovery unit 100, to thermally condition them and/or remove vapor refrigerant. The second time delay function can be, for example, about a 5 second time delay function during which a significant amount of vapor refrigerant originally contained in the service hoses 124, 128 is replaced with recirculated condensed refrigerant. Other time delays can include 3, 4, 6, 7, 8 . . . etc., seconds delays as it may be predetermined or in some embodiments adjusted based on sensor data. For example, in some embodiments, at step 621, one or more temperature sensor 317*d* can be located anywhere along the length or near the service hoses 124, 128 to measure the ambient temperature or internal temperature.

Temperature control inside the service hoses 124, 128 is desired to prevent refrigerant from condensing and staying in the cooler sections of the service hoses 124, 128 during charge. The remaining condensed refrigerant in the service hoses 124, 128 which can create significant variations of the amount of refrigerant that was actually charged. Furthermore, by obtaining a constant radio of liquid to gas refrigerant, or removing all or substantially all gas refrigerant prior to charging, the charging accuracy of the refrigerant recovery unit 100 can be increased. For example, in some embodiments, the amount of liquid refrigerant contained in both service hoses 124, 128 can account, for example, anywhere from about 183.00 grams when it is mostly liquid refrigerant to about 6.00 grams when it is mostly vapor refrigerant. Consequently, it is important to know the actual weight of the refrigerant contained in the service hoses 124, 128, whether any will remain due to temperature differentials, and compensate for it in the reference weight of a refrigerant storage tank 212, or to eliminate the variables, to improve charge accuracy of the refrigerant recovery unit 100. Accordingly, in some embodiments one or both said first and second time delay functions can last longer periods of time to thereby allow the thermal conditioning of one or both service hose(s) 124, 128 to occur through the recirculation of refrigerant. In addition, the length of time of each time delay may be predetermined depending on the application, based on sensor readings of ambient surrounding conditions as previously mentioned, and/or, type of refrigerant, service hose(s) 124, 128 compositions, insulation materials, internal surface characteristics, refrigerant type, charging conditions, and the like.

The recirculating circuit 400 may be a flexible hose or any other suitable conduit for providing fluid communication, and forming a flow path loop between the refrigerant system 200 coupler 226, 230 ends of one or both of the high end service hose 124 and the low end service hose 128 to a part of the system capable of removing vapor refrigerant, such as the system oil separator 262. Generally, the recirculating circuit 400 can be a parallel refrigerant conduit for each, or both, service hoses 124, 128, connected near or at the hose couplers 226, 230. In some embodiments, the parallel refrigerant conduit(s) may be contained in a conduit hose material enclosing. This may be advantageous, for example, to prevent entanglement of the parallel lines. Valves may be electronically activated solenoid valves controlled by the controller 216. The connections may be a wireless or wired connections. In other embodiments the valves may be manual user activated valves.

At step 622, in some embodiments alternatively or in addition to the recirculating of refrigerant, the resistance heater 315 (shown in FIG. 3) along the length of the service hoses 124, 128 can be activated, according to a measured temperature or preprogrammed function, to provide a constant temperature along the interior surfaces of the service hoses 124, 128, for example, before the transfer of refrigerant begins and/or according the one or more temperature readings at step 621.

Subsequent to the second time delay, at step 620, the recirculating valve 403 is closed. Following, at step 625, an initial scale weight $W_1$ can be taken by scale 215. $W_1$ can be a reference weight of the refrigerant storage tank 212 when the charging path including the service hoses 124, 128 up to hose fill valves 401, 402 are filled with liquid refrigerant. At step 630, in some embodiments, the hose fill valves 401, 402 can be opened to allow the charging of refrigerant to the refrigerant system 200 via the couplers 226 (high side) and 230 (low side), respectively.

At step 635, at least a second weight measurement $W_2$ by scale 215 is taken to determine if the change in mass from $W_2-W_1$ is equal to the target weight at step 640 of the refrigerant required for proper service of the refrigerant system 200. The target weight at step 640 can be, for example, the refrigerant weight as provided by the system's specifications. When the target change in weight is less than desired, more refrigerant can be added to the system and another weight can be taken until the target weight is met. Once the proper amount of refrigerant has been added to the refrigerant system 200, at step 645, the charge and hose fill solenoids can be closed to complete the charging.

Referring now to FIG. 3, the refrigerant recovery unit 100 connected to a refrigerant system 200 of a vehicle and an enlarged cross section of an exemplary temperature controlled service hose 124, 128 are depicted. In particular, the refrigerant stored in the refrigerant storage tank 212 can be charged with increased accuracy into the refrigerant system 200 using thermally controlled service hose(s) 124, 128. No limitations are placed on the kind of refrigerant that may be used according to the present disclosure. As such, any refrigerant that is commonly available (e.g., R-134a, $CO_2$, R1234yf, etc.) may be stored within the refrigerant storage tank 212. However, according to certain embodiments of the present disclosure, the refrigerant storage tank 212 can be particularly configured to accommodate refrigerants that are commonly used in refrigeration systems 200, such as air conditioning systems.

A refrigerant system 200 can be charged using service hose(s) 124, 128 which are configured to facilitate transfer of the refrigerant from the refrigerant storage tank 212 to the refrigerant system 200. The service hose(s) 124, 128 may include and/or be extended by one or more hoses (not shown). According to aspects of the present disclosure, one or both service hoses 124, 126 can include a resistance heater 315 along the length of the service hoses 124, 128. The resistance heater 315 can be flexible and include, and/or, be capable of conducting heat to heat conductors 310 that can conduct and spread heat around the internal walls of the service hoses 124, 128.

Heat conductors 310 may be arranged in ring patterns, spiral patterns, and/or grid patterns, along the length of the service hoses 124, 128. Alternatively, the internal walls of the service hoses 124, 128 may include a conductive flexible material and/or thermal storage material including, for example, metals, paraffin wax material, synthetic rubber, polyethylene, and known service hose materials of the like. Other types of heaters and/or methods of controlling the internal temperature of the service hoses 124, 128 to increase the charge accuracy of a refrigerant recovery unit 100 are within the scope of the disclosure. For example, as disclosed herein, using a recirculating circuit 400 to thermally condition the service hoses 124, 128 through the flow of refrigerant along the length of the service hoses 124, 128 prior to charging. In some embodiments, both a recirculating circuit 400 and a resistance heater 315 can be included in the refrigerant recovery unit 100.

In some embodiments, an insulating material 305 can be included along the length of the service hoses 124, 128 to allow handling of the service hoses 124, 128. Insulating material 305 can include a rubber, foam, polymer, and other known insulating materials of the like. Insulating material 305 can further include a coating layer 301 used for protection of the service hoses 124, 128. One or both of the insulating material 305 and the coating later 301 can protect the hose, internal components, and a user from electric shock and burning temperatures when handling the service hoses 124, 128. The coating 301 composition and the insulating 305 composition can include the same materials or different depending on the embodiment.

Figure 4:
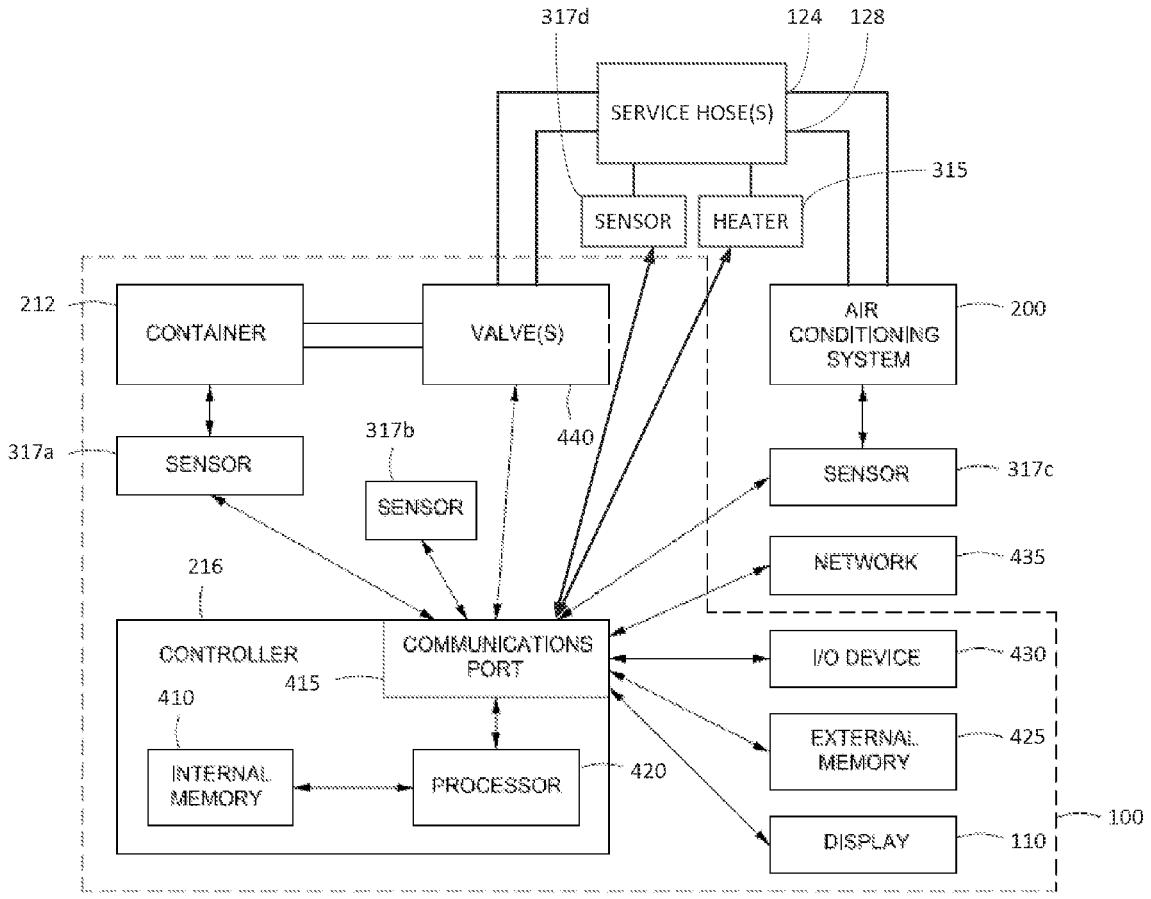
FIG. 4 is a schematic diagram of some components included within and/or that may be connected to a refrigerant recovery unit.

Referring now to FIG. 4, a schematic diagram showing additional components that can be included within and/or that may be connected to the refrigerant system 200 is illustrated. In particular, FIG. 4 illustrates that the controller 216 can include an internal memory 410, a processor 420 and a communications port 415. The representative communications port 415 can also be connected to an external memory 425, a display 110, an input/output (I/O) device 430, a network 435, the one or more temperature/pressure sensor(s) 317*a-d* that can monitor the temperature and/or pressure in the refrigerant storage tank 212, the service hoses 124, 128 and external ambient temperatures and pressures.

According to aspects of the present disclosure, the one or more temperature/pressure sensor(s) 317*a-d* can be configured to determine and/or sense a temperature/pressure within the refrigerant storage tank 212, ambient temperature, and/or inside one or both service hose(s) 124, 126. For example, temperature sensor 317*a* may be placed, on the outside of the refrigerant storage tank 212 or inside of the refrigerant storage tank 212. Further, depending on the type of temperature sensor(s) 317*a-d* used or as desired by the user, the temperature sensor 317*a* may be placed on an upper, middle or lower portion of the refrigerant storage tank 212. In another embodiment, temperature sensor 317*b* may be placed at or near the point where the refrigerant exits the refrigerant storage tank 212. In still another embodiment, temperature sensor 317*d* may be placed in or outside one or both service hose(s) 124, 128. In a further embodiment, the temperature sensor 317*d* may also be placed anywhere among the components (hoses, fittings, valves, etc.) that are between the refrigerant storage tank 212 and the refrigerant system 200 being charged with refrigerant.

In another embodiment, a temperature sensor 317*c* may be placed on an outside surface of a housing 102 of the refrigerant recovery unit 100. In a further embodiment, the temperature sensor 317*c* may be placed within the housing 102. The placement of temperature sensor 317*c* can be anywhere on or in the housing 102 so long it can measure the surrounding ambient temperature.

In addition, the controller 216 can be included in the refrigerant recovery unit 100 and in connection with components including, for example, the temperature sensor(s) 317*a-d*, the service hose(s)' heater 315, and recirculating valves 440 to regulate and/or compensate for temperature differentials and increase change accuracy according to aspects of the disclosure. For example, the one or more temperature sensor(s) 317*a-d* may transmit the sensed temperature via a wired or wireless connection. The sensed temperature may be transmitted when requested by the controller 216, for example, prior to initiating the charge cycle and/or during refrigerant recirculation, or pushed all the time or on a predetermined basis, such as every 30 seconds, minute, 5 minutes, 15 minutes, 30 minutes, hour, etc.

Also illustrated are valves 440 (e.g., solenoid valves described in FIG. 2) that, according to certain embodiments, can either be included within or in fluid connection to the service hose(s) 124, 126. When the refrigerant recovery unit 100 is in operation, the valves 440 may be opened and shut by the controller 216 based on programmed steps and functions including, for example, the steps discussed in this disclosure. For example, the controller 216, can be configured to control the service hose connections valves 226, 230 to thereby control how much refrigerant flows from the refrigerant storage tank 212 to the refrigerant system 200.

In addition, the controller 216 can also be configured to determine a compensated amount of refrigerant to be added to the refrigerant system 200. Such a determination may be made, for example, based upon the refrigerant temperature obtained from within the refrigerant storage tank 212 and refrigerant system 200, the temperature obtained inside or on one or both service hose(s) 124, 128, and/or the ambient surrounding temperature.

Either or both of the memories 410, 425 may be configured to store one or more formulas and one or more measured temperatures and/or system condition thresholds that can be used to calculate the amount of compensated refrigerant that should be added to a refrigerant system 200 based upon relative temperature measured at the refrigerant storage tank 212 and the refrigerant system 200. For example, when a vehicle's refrigerant system 200 is one included in an automobile, one or more of the temperature sensor 317 may be connected to or may be a part of the automobile's on-board diagnostic (OBD) system (not shown). In such instances, the communications port 415 of the controller 216 may receive temperature information from the OBD system using a data link connector (not shown) connected via the communications port 415.

Also, a refrigerant recovery unit's manufacturer may publish empirical data in a similar format for a variety of refrigerant systems and/or refrigerants and/or environmental conditions. Then, information about one or more of the optimal amounts can be, for example, downloaded to the internal memory 410 of the controller 216 from the network 435, which may be an intranet, the Internet, LAN, WAN, or some other electronic network. As an alternative, information from a disc or other electronic network may be transferred directly to the controller 216 when the I/O device 430 takes the form of a CD or DVD reader/writer, or USB connector. Once a sufficient amount of information has been imported, the refrigerant recovery unit 100 may be used to charge or recharge the refrigerant system 200.

Figure 5:
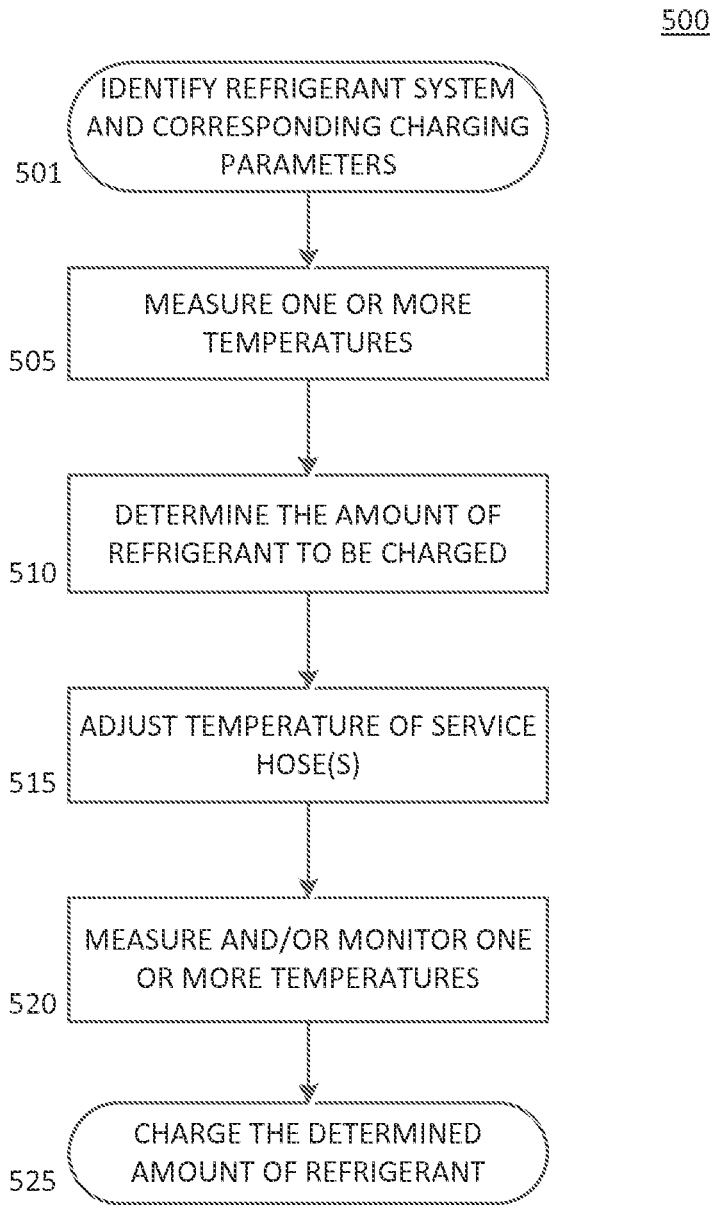
FIG. 5 is a flowchart illustrating method steps to charge a refrigerant system according to embodiments of the disclosure.

Referring now to FIG. 5, a flowchart illustrating method steps 500 to charge refrigerant into a refrigerant system 200 according to aspects of the disclosure is depicted. The method can start at step 501 with the identification of the refrigerant system 200 to be charged. The identification may include, in some embodiments, identifying the type of refrigerant, amount of refrigerant, recommended charging temperatures and conditions, and the such, as per manufacturer's specifications. The refrigerant system 200 can be, for example, the A/C system in a vehicle and the user can select the make and model of vehicle from a list presented on the display 110 of the refrigerant recovery unit 100. Alternatively, the user can enter the vehicle make and model (or VIN) using the key pad. Other types of A/C systems are also within the scope of the present disclosure, including those in residential or commercial buildings, planes, farm machinery, etc.

At step 505, one or more temperature readings can be taken. Temperature reading(s) can include, for example, measuring a first temperature of the refrigerant storage tank 212 using temperature sensor 317*a* and a second temperature sensor 317*d* within the service hoses 124, 128. Since the temperature sensor 317*c* may be part of a vehicle's larger system (e.g., an automobile's OBD system), according to certain embodiments of the present disclosure, step 505 may include obtaining the second temperature from a computer that is at least partially controlling a portion of the refrigerant system 200.

At step 515, the interior temperature of one or both service hose(s) 124, 128 can be adjusted to eliminate temperature differentials along the length of the service hose(s) 124, 128 and/or between one or more of the refrigerant storage tank 212, ambient conditions, and the refrigerant system 200. Adjustment of the temperature can include, for example, the methods described in this disclosure to heat/align the internal temperature of the service hoses 124, 128. Other methods/systems can include, for example, a parallel flow of heated liquid flowing around the external boundaries containing the refrigerant. By reducing the temperature differential between the refrigerant storage tank 212 and inside the service hoses 124, 128, a more accurate amount of refrigerant may be added to refrigerant systems 200. Thus, amounts of refrigerant that may have remained trapped in service hoses 124, 128 or fittings during a charge may be eliminated or significantly reduced to increase charge accuracy, thereby increasing refrigerant system's 200 performance.

Moreover, in some embodiments at step 520, temperature measurements may be taken throughout the charging of refrigerant continuously and/or at a predetermined frequency to monitor conditions and alert the user and/or stop the charging upon sensing a condition differential that is above or below a predetermined threshold. This function may not only increase charge accuracy but also act as a safety check for the refrigerant recovery unit 100. Finally, when measured conditions are at an acceptable level, at step 525, the refrigerant system 200 is charged with the determined amount of refrigerant with greater accuracy and more safely.

The many features and advantages of the disclosure are apparent from the detailed specification, and thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the disclosure.

What is claimed is:

1. A method of adding refrigerant to a refrigerant system, the method comprising:

obtaining a recommended amount of refrigerant for the refrigerant system;

obtaining a first temperature reading;

conditioning an interior temperature of a service hose according to said first reference temperature;

obtaining a second temperature reading and conditioning the interior temperature of the service hose based on the temperature readings differential between the first temperature reading and the second temperature reading; and charging the refrigerant system with the recommended amount of refrigerant.

2. The method of claim 1, wherein said service hose comprise a heater along the length of the hose to condition the temperature.

3. The method of claim 1, wherein said service hose include a parallel flow of heated liquid capable of heating the refrigerant flow path.

4. The method of claim 1, wherein the interior of said service hose include a composition capable of storing heat.

5. The method of claim 1, wherein the interior of said service hose include a heat conducting material.

6. The method of claim 1, wherein said service hose include an insulating material.

7. The method of claim 1, wherein the conditioning of the interior temperature of the service hose is controlled by a controller and according to received temperature readings.

8. The method of claim 7, additionally comprising taking one or more additional temperature readings throughout a charging cycle to monitor charging accuracy.

9. A refrigerant recovery unit comprising:

a refrigerant storage tank configured to store a refrigerant;

one or more service hoses configured to facilitate transfer of the refrigerant from the refrigerant storage tank to a refrigerant system;

a first temperature sensor configured to determine a first temperature within the one or more service hoses;

a second temperature sensor configured to determine a second temperature within the refrigerant recovery unit; and a controller configured calculate a first temperature differential between the first and second temperatures, and using the temperature differential to control a heater used to thermally control the temperature within the one or more service hoses.

10. The refrigerant recovery unit of claim 9, wherein the heater is capable of transmitting heat to at least a portion of the interior of the one or more service hoses.

11. The refrigerant recovery unit of claim 9, further comprising a recirculating circuit that is parallel to a length of one or more of the service hoses to recirculate refrigerant from a connection on or near a coupler on a system interface end of one or both hoses(s) before charging the refrigerant system.

12. The refrigerant recovery unit of claim 9, further comprising a parallel line around a refrigerant flow path inside a service hose with a heated liquid, the parallel line being capable of thermally conditioning the refrigerant flow path.

13. The refrigerant recovery unit of claim 9, wherein an interior of said one or more service hoses include one or more of: a composition capable of storing heat, a heat conducting material, and an insulating material.

14. The refrigerant recovery unit of claim 9, further comprising a third temperature sensor configured to measure a third temperature at the refrigerant system, the third temperature sensor being electronically connected to the controller.

15. The refrigerant recovery unit of claim 9, further comprising a communications port electronically connected to the controller and to a processor that is at least partially controlling a portion of the refrigerant system.

16. The refrigerant recovery unit of claim 15, wherein the communications port is configured to receive the information about a recommended amount of refrigerant from an input device used by a user.

17. A method of adding refrigerant to a refrigerant system, the method comprising:

obtaining a recommended amount of refrigerant for the refrigerant system;

obtaining a first temperature reading;

conditioning an interior temperature of a service hose according to said first temperature reading; and charging the refrigerant system with the recommended amount of refrigerant, wherein said service hose is in fluid connection with a recirculating circuit that is parallel to a length of the service hose to recirculate refrigerant from a system interface coupler end of said service hose before charging the refrigerant system.

18. The method of claim 17, wherein said service hose comprise a heater along the length of the hose to condition the temperature.

19. The method of claim 17, wherein said service hose includes a parallel flow of heated liquid capable of heating a refrigerant flow path.

20. The method of claim 17, wherein an interior of said service hose includes a composition capable of storing heat.

21. The method of claim 17, wherein an interior of said service hose includes a heat conducting material.

* * * * *